United States Patent [19]

Hawkins, Sr.

[11] 4,333,260

[45] Jun. 8, 1982

[54] HOOP GUIDING AND BRAKING APPARATUS

[76] Inventor: Edward Hawkins, Sr., 117 Fisher Ave., Piscataway, N.J. 08854

[21] Appl. No.: 253,101

[22] Filed: Apr. 13, 1981

[51] Int. Cl.[3] ..... A63H 33/02

[52] U.S. Cl. ..... 46/220

[58] Field of Search ..... 46/220, 114; 40/606, 40/610

[56] References Cited

U.S. PATENT DOCUMENTS

| | | | |
|---|---|---|---|
| 385,704 | 7/1888 | Gardy | 46/220 X |
| 1,451,258 | 4/1923 | Hannek | 46/220 |
| 1,451,391 | 4/1923 | Hendrix | 46/220 X |
| 3,123,937 | 3/1964 | Pace | 46/220 |
| 3,591,116 | 7/1971 | Dalum | 40/610 X |

FOREIGN PATENT DOCUMENTS

| | | | |
|---|---|---|---|
| 778845 | 3/1935 | France | 46/220 |

*Primary Examiner*—Hugh R. Chamblee
*Assistant Examiner*—Mickey Yu
*Attorney, Agent, or Firm*—Arthur L. Plevy

[57] ABSTRACT

A guide rod for rolling a hoop consists of a front wire loop which has a top section defined by two outwardly sloping arms. The arms are then directed parallel towards one another and bent transversely to form a bottom propelling arm. The loop is retained within a slot formed in an intermediate support which section is adjustably mounted within a handle or grip section. In this manner, the guide apparatus can be adjusted in length with the loop section serving both as a propelling means for a hoop, and a braking means for the hoop, under control of a user. The loop as above described is symmetrically disposed about the support section and hence the guide stick can be used by a left or a right handed individual.

8 Claims, 5 Drawing Figures

HOOP GUIDING AND BRAKING APPARATUS

BACKGROUND OF INVENTION

This invention relates to an improved guide stick for propelling a play hoop or wheel and more particularly to an adjustable guide stick which can be used by a right or a left handed individual and which further provides a unique braking action.

The prior art is replete with many patents which involve devices for rolling wheels or hoops along the ground. These devices provide great amusement for children and have found widespread uses. The wheel or hoop may simply constitute a rubber or metal rim while the rod or guide stick in the simplest case may just be an elongated piece of wood which is used to engage the outer periphery of the wheel to keep the same in a rolling mode. In regard to such structures the patent art depicts a number of patents which exactly pertain to such structures as can be ascertained from the prior art. These patents differ in the construction of the guide stick or in the construction of the hoop.

U.S. Pat. No. 2,984,937 entitled HOOP MEANS issued on May 23, 1961 to B. J. Rendon, depicts a hoop with a guide stick having a U shaped front end. The patent is typical of the type of devices described above.

U.S. Pat. No. 3,078,620 entitled HOOP ROLLING STICKS issued on Feb. 26, 1963 to C. L. Frye, Jr. et al., shows a hoop stick having a slot extending through the shaft to provide a seat for guiding the hoop.

U.S. Pat. No. 3,531,889 entitled TOY HOOP GUIDE AND PROPELLING DEVICE issued on Oct. 6, 1970 to B. T. Poole. This Patent shows a propelling device which has a U shaped member arranged at an acute angle with respect to the shaft and used to propel a hoop.

U.S. Pat. No. 3,619,942 entitled ROLLABLE TOY issued on Nov. 16, 1971 to R. De Lara, shows a guide stick which is used to roll and support the hoop under control of a user. The apparatus includes an annular track on the inside of the ring with a ball which rides or rolls in the track as the hoop is being propelled.

U.S. Pat. No. 4,173,841 entitled TOY HOOP GUIDING ROD issued on Nov. 13, 1979 to R. K. Hensley and shows a guide rod for a hoop having a U shaped front section which can be disposed in either a right or a left hand orientation to enable a right or a left handed individual to control a hoop. Other patents as U.S. Pat. No. 4,188,749 depict different structures for forming a hoop in order to reduce noise or to create noise, as well as, to provide different visual effects as the hoop is being propelled.

In regard to the above noted patents and other prior art, there is a great number of devices which provide guide rods with various adjustments to provide various operations. Many of these devices are complicated and difficult to manufacture while other devices do not accomodate the needs of children of various sizes. The above noted devices do not provide any means for stopping and capturing a hoop once it is being rolled or for braking such a hoop during operation. It is therefore the object of the present invention to provide an improved guide stick for use with a hoop or wheel which guide stick is adjustable in length to accomodate children of various sizes and is further capable of being used, without adjustment, by a right or a left handed individual. The guide stick to be described has a built in brake accomodating means to enable a user to stop or slow a wheel during a rolling operation.

BRIEF DESCRIPTION OF THE PREFERRED EMBODIMENT

A roller hoop or wheel guide comprises an elongated shaft section provided with a handle section at one end and a hoop engaging section at the opposite end. The hoop engaging section comprises a loop having a top section as directed from said shaft section manifested by two symmetrical sloping side arms forming a V configuration and thence directed relatively parallel to one another with a downward transverse bend in each arm at the end remote from said shaft section to form a cross bar between said arms for propelling a wheel emplaced between said arms with said V configuration operative to exert a braking force against the sides of said wheel as imparted by a user during a rolling operation to slow or stop said wheel when rolling.

DETAILED DESCRIPTION OF THE FIGURES

Figure 1:
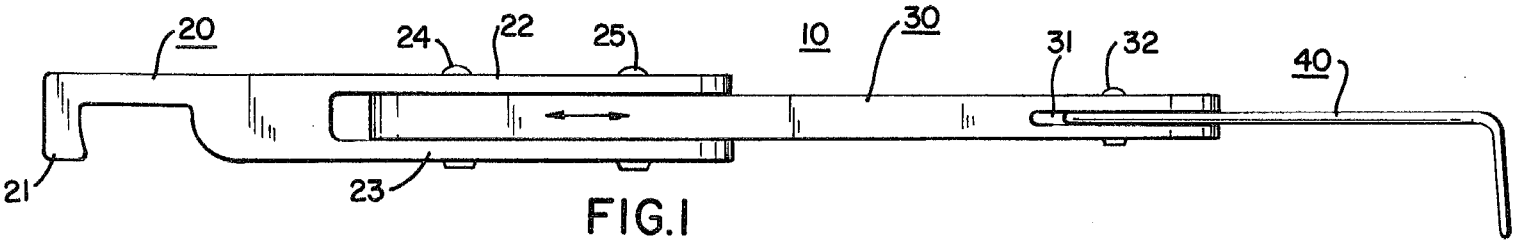
FIG. 1 is a side elevational view of a hoop guide apparatus according to this invention.

Referring to FIG. 1 there is shown a guide stick 10 which essentially consists of three separate pieces as will be explained. The guide stick 10 is shown in a side view and has a first handle section 20 which has a grip 21 integrally formed with a top projecting member 22 and a bottom projecting member 23. Members 22 and 23 form a fork-like configuration with the grip section 21. A support section 30 is a longitudinal member having a width of a dimension adapted to fit between the projections 22 and 23 of the handle section 20. Located at the opposite end of the support member 30 is a slot 31 having inserted therein a a relatively rigid wire loop propelling member 40 which as will be explained is used to both propel and brake a wheel or hoop. The support section is slideably positioned between the projections 22 and 23 and held in a desired position by means of bolts 24 and 25. The loop 40 is positioned within slot 31 and held in place by means of a bolt or fastener 32.

Figure 2:
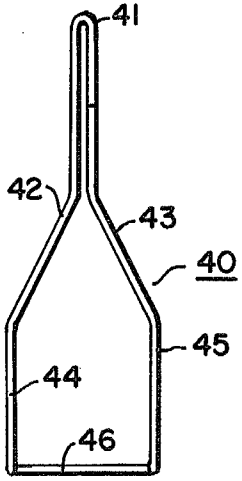
FIG. 2 is a top plan view of a wire loop according to this invention.

Referring to FIG. 2 there is shown a top plan view of the loop 40. Essentially, the loop 40 consists of a relatively thick wire which is fabricated from a strong metal or plastic and is rigid in structure. The top portion 41 of the wire loop 40 is bent to form an opening of a length and width to accomodate insertion of the same within the slot 31 of the support member 30. Directed downwardly from the top section 41 is a left and a right sloping arms 42 and 43 which form a V shaped section. A bottom section of the loop has relatively parallel arms 44 and 45 the ends of which are bent transversely to form a bottom propelling arm 46. As will be explained, the bottom arm 46 serves to push the wheel and hence to keep the same rolling with the side arms 44 and 45 acting as a guide for the wheel and to prevent the same from wobbling during operation. If the user exerts a greater force downwardly on the wheel the sloping side portions 42 and 43 will engage the sides of the wheel and stop the same. Depending upon the force exerted by the user, the side arms 42 and 43 can slow the wheel or capture the wheel to completely stop the rolling motion as desired.

Figure 3:
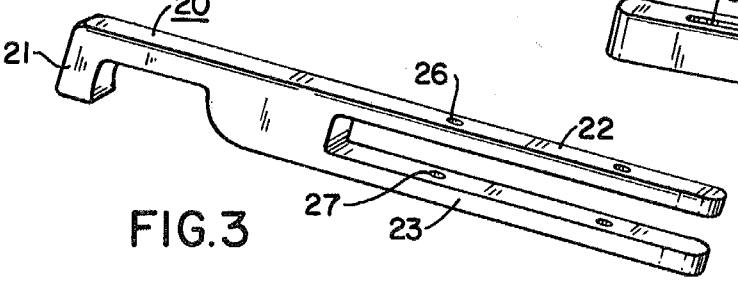
FIG. 3 is a perspective plan view of a handle section.

Referring to FIG. 3 there is shown a perspective view of the handle section 20. There can be seen from FIG. 3, the projecting members 22 and 23 with suitable corresponding apertures as 26 and 27 which will accomodate a bolt or other fastening device to retain the support member affixed thereto once the desired adjustment has been made.

Figure 4:
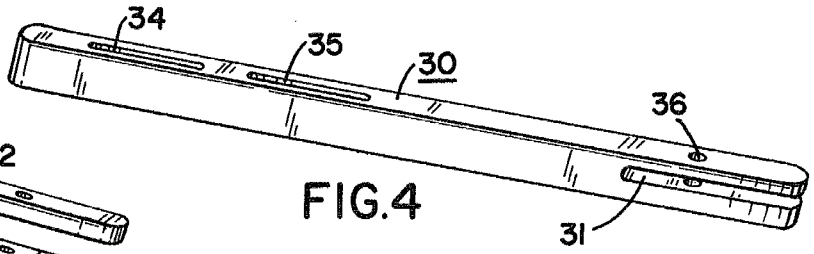
FIG. 4 is a perspective plan view of a support section.

Referring to FIG. 4 there is shown a perspective plan view of the support member 30. The support member 30 has two elongated slots 34 and 35 which slots are positioned at the front end, disposed between the projecting members 22 and 23 of the handle section 20. As can be seen, if the bolt members 24 and 25 are loosened, one can then slide the support section 30 with respect to the handle section 20 to adjust the effective length of the guide stick 10. It is of course understood that a single slot can be employed as well. It is also understood that one can use the support member 30 without the handle member 20 if desired. Also shown in FIG. 4 is an aperture 36 through which the bolt 32 is inserted to retain the loop 40 within the slot 31.

Figure 5:
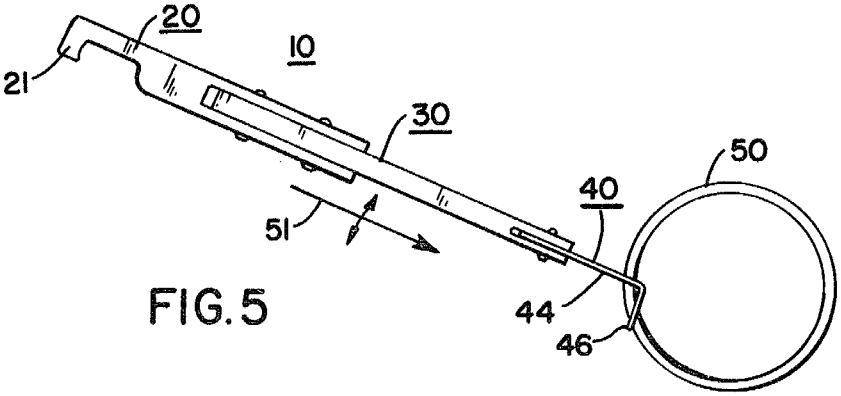
FIG. 5 is a side view of a hoop guide propelling a hoop or wheel.

Referring to FIG. 5 there is shown the guide apparatus 10 in position with a hoop or wheel 50. As can be seen from FIG. 5, a user upon grasping the handle 21 can push the wheel 50 and by means of the cross bar 46 the wheel will be propelled as shown with the side arms 44 and 45 providing support. If the user exerts a stronger downward motion in the direction of arrow 51, the wheel 50 which may be rubber or plastic will be pushed into the slope section manifested by arms 42 and 43. The arms will exert a force against the side of the wheel to slow the same or if the force is great enough will actually capture the wheel due to the inherent flexibility of the wire loop 40. It is of course now understood that the wheel loop 40 as compared to propelling arms of the prior art enables use of a guide stick by a right or a left handed individual as the loop 40 is completely symmetric and is symmetrically disposed about the main axis of the support section 30.

Essentially, the wire loop shown in FIG. 2 is approximately 12" from top to bottom with the spacing between arms 44 and 45 being about 4". The wire is bent at an angle of approximately 90° as shown in FIG. 1 to a length of 3" after which the arm 46 is then directed across. As can be seen, the loop 40 can be formed from a single piece of wire approximately $\frac{3}{8}$" in diameter and fabricated from steel or another suitable material. Distance between the sloping side arms 42 and 43 is about $1\frac{1}{2}$" at the top and 4" at a distance approximately 8" from the top. The support section 30 is about 23" in length and about $1\frac{1}{4}$" wide and $\frac{5}{8}$" thick. The handle section 20 is approximately 18" in length with the projecting arms about 10" and the space between the projecting arms slightly greater than the width of the support section 30.

The entire unit can be fabricated from plastic, wood or some other suitable material. It is of course understood that various modifications and alternative structures will be discerned by those skilled in the art and such modifications and alternations are deemed to be encompassed within the scope of the claims appended hereto.

I claim:

1. A roller hoop or wheel guide apparatus comprising:

an elongated member manifesting a support section, said member having a central slot at one end, and having at least one opening transverse to said central slot near the opposite end of said elongated member with said opening directed from the top surface to the bottom surface of said elongated member, a handle section having a grip member adapted to be grasped by the hand of a user, first and second projecting members extending from said grip member to form a fork and separated one from the other to form a support accomodating space with one end of said support section inserted within said space with said opening underlying said projecting members, a hoop engaging section comprising a loop having a top section in a plane parallel to said support section as directed from said support section manifested by two symmetrical sloping side arms forming a V configuration and thence directed relatively parallel to one another in the same plane, and then having an abrupt downward transverse bend in each arm at the end remote from said support section to form a cross bar between said arms for propelling a wheel emplaced between said side arms, with said V configuration operative to exert a braking force against the sides of said wheel as imparted by a user during a rolling operation to slow or stop said wheel when rolling with the apex of said V inserted into said central slot of said support member.

2. The apparatus according to claim 1 wherein said loop is formed from a relatively rigid single length of wire material.

3. The apparatus according to claim 1 including fastening means for securing said handle section to said support section and positioned within said opening.

4. The apparatus according to claim 3 wherein said fastening means comprises at least one bolt member positioned in an aperture in said first projecting member and a corresponding aperture in said second projecting member and directed through said opening for permitting said support section to adjustably slide with respect to said handle section to enable one to vary the effective length of said wheel guide apparatus for rigidly securing said handle to said support section at any one selected length.

5. The apparatus according to claim 1 wherein said top section of said loop has a first upper portion prior to said V configuration manifesting a narrow arcuate passageway for insertion into said slot of said elongated support section.

6. The apparatus according to claim 5 including means for coupling said loop via said central slot of said support section.

7. The apparatus according to claim 1 wherein said support section has another opening directed from the top to the bottom and adjacent said at least one opening.

8. The apparatus according to claim 7 wherein said first and second projecting members of said handle section each have first and second corresponding apertures located through the surface thereof to overlie said openings of said support section when emplaced within said support accomodating space and means positioned through said apertures and openings to slideably couple said handle section to said support section.

* * * * *